US007455605B2

(12) United States Patent
Rangel

(10) Patent No.: US 7,455,605 B2
(45) Date of Patent: Nov. 25, 2008

(54) VARIABLE LENGTH FLETCHING SYSTEM AND METHOD FOR USING SAME

(76) Inventor: Louis Rangel, 7173 Archibald, #226, Alta Loma, CA (US) 91701

( * ) Notice: Subject to any disclaimer, the term of this patent is extended or adjusted under 35 U.S.C. 154(b) by 0 days.

(21) Appl. No.: 10/932,164

(22) Filed: Sep. 1, 2004

(65) Prior Publication Data

US 2005/0049091 A1 Mar. 3, 2005

Related U.S. Application Data

(60) Provisional application No. 60/499,553, filed on Sep. 2, 2003.

(51) Int. Cl.
*F42B 6/06* (2006.01)

(52) U.S. Cl. ..... 473/586

(58) Field of Classification Search ..... 473/578, 473/585, 586
See application file for complete search history.

(56) References Cited

U.S. PATENT DOCUMENTS 2,830,818 A * 4/1958 Otto ..... 473/586
3,815,916 A * 6/1974 Meszaros ..... 473/586
3,922,401 A * 11/1975 Bear ..... 427/290
4,204,307 A * 5/1980 Pfetzing ..... 29/407.09
4,234,192 A * 11/1980 Salamone ..... 473/586
4,583,745 A * 4/1986 Ladner ..... 473/586
4,615,552 A * 10/1986 Bengtson ..... 473/586
5,427,385 A * 6/1995 Conrad et al. ..... 473/586
5,443,272 A * 8/1995 Vincent, Sr. ..... 473/578
5,443,273 A * 8/1995 Lovorn ..... 473/586
6,641,493 B1 * 11/2003 Shifflett ..... 473/578

* cited by examiner

*Primary Examiner*—John Ricci
(74) *Attorney, Agent, or Firm*—R. Dabney Eastham

(57) ABSTRACT

An arrow fletching system having a continuous roll or individual lengths of base material to which is applied a series of vane segments. The benefit of this fletching system is that an arrow can be fletched with an equal number of vane segments in each fletching area without measuring and/or weighing each of the sections. This results in a balanced arrow which can be easily modified to add or reduce the number of segments.

6 Claims, 3 Drawing Sheets

PRIOR ART

VARIABLE LENGTH FLETCHING SYSTEM AND METHOD FOR USING SAME

RELATED APPLICATION

This application claims priority to Provisional Patent Application Ser. No. 60/499,553, entitled Variable Length Fletching System and Method for Using the Same, filed Sep. 2, 2003.

BACKGROUND

1. The Field of the Invention

The present invention relates to a method and apparatus for varying the length of a vane used in fetching on an arrow shaft. More specifically, the invention relates to a method for dispensing vane material in a segmented fashion so that the length of the vane may be altered prior to and/or after adhering the vane to the arrow shaft.

2. Background

Current arrow fletching usually comprises three vanes or feathers which are each made of a continuous vane material. This vane material has a base which is slightly wider than the vane so as to increase the surface area for bonding with the arrow shaft. During use of the arrow, the vane material may become damaged with a tear or a hole due to the passage of a subsequently shot arrow through the vane material or by the target itself. Because the vanes are typically made of a one-piece material, the vane cannot deform sufficiently to avoid damage.

When determining the appropriate length of fetching on an arrow, a trial and error method is typically employed. With not enough fletching, the flight of the arrow shaft will be erratic. With too much fetching material, the arrow will become too heavy and will cause additional drag due to the unnecessary fletching material. The arrow may also be unbalanced. Unfortunately, there is no easy method for removing identical amount of fletching from each of the three vanes when experimenting with the appropriate amount of fletching material.

SUMMARY AND OBJECTS OF THE INVENTION

Certain embodiments of the present invention comprise a roll or length of fletching material or vane having repeating segmented vane sections over a continuous base section. The continuous base section allows vane sections to remain together during storage while allowing such vane sections to be easily separated and severed for use. The base section also provides for additional surface area for adhesive to bond the fletching material to the arrow shaft. The segments also allow for easy adjustment of the length of fletching on an arrow shaft. For example, if an archer creates an arrow and fletches it with three equal lengths of fletching comprising five vane segments each, and if the archer then decides that there is too much fletching, one segment can easily be removed from each of the three fins. In this manner, an equal amount of fletching material will be removed and the arrow will remain balanced. Likewise, segments may be severed from the roll or length of fletching material and an equal number added to each of the fins to provide additional arrow control. In this manner, an arrow may be easily modified to achieve a particular balance while retaining symmetry across the vanes.

Further, certain embodiments of the present invention comprise repeatable vane segments that are more flexible and pliable than prior art vanes. Vane sections in accordance with the present invention are thus more likely be deflected from the flight path of another arrow, thereby reducing and/or preventing damage to the vane that may otherwise result.

Vane segments in accordance with selected embodiments of the present invention may comprise various sizes and shapes arranged in a repeatable pattern such that trial and error testing may be utilized to determine an appropriate length of fletching. Once such an appropriate length is ascertained, the user may then fletch other arrows of similar dimension and weight by simply determining the number and shape of the segments attached to the properly balanced arrow and mirroring such fletching on the other arrows.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term "fletching" or "fletching material" refers to feathers or vanes, or an arrangement thereof, on an arrow. The term "vane" refers to a feather fastened to the shaft of an arrow near the nock. The term "nock" refers to the part of an arrow having a notch for the bowstring.

Figure 2:
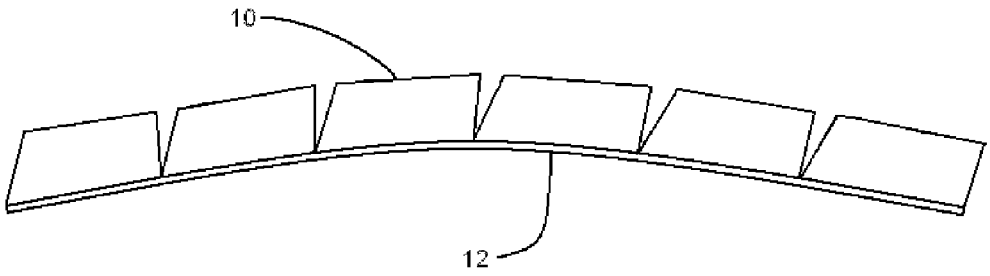
FIG. 2 is a side view of a multiple repeating vane segments connected by a continuous base material.

As shown in FIG. 2, embodiments of the present invention relate to a system and method for dispensing and/or allocating fletching material comprising a continuous roll of base material 12 to which is affixed a continuous series of repeating vane segments 10, or, alternatively, individual lengths of base material 12 having repeatable vane segments 10 attached thereto.

Figure 3:
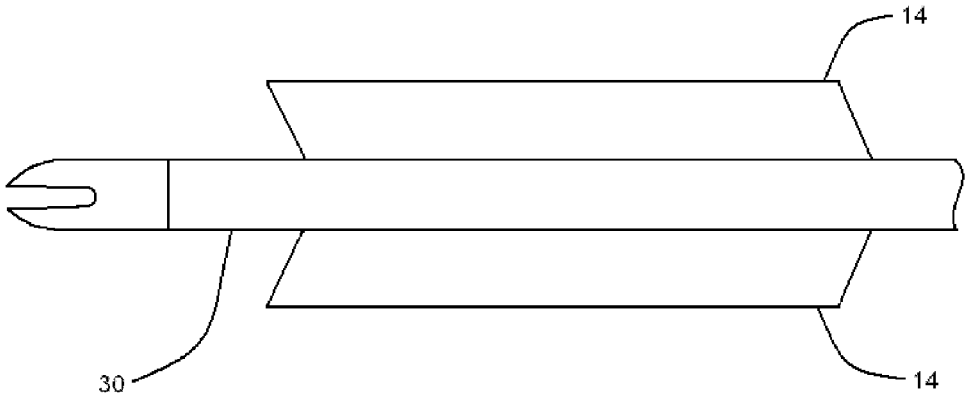
FIG. 3 is a side view of the prior art.

FIG. 3 depicts a prior example showing single vane segment 14 attached to arrow shaft 30.

Figure 1:
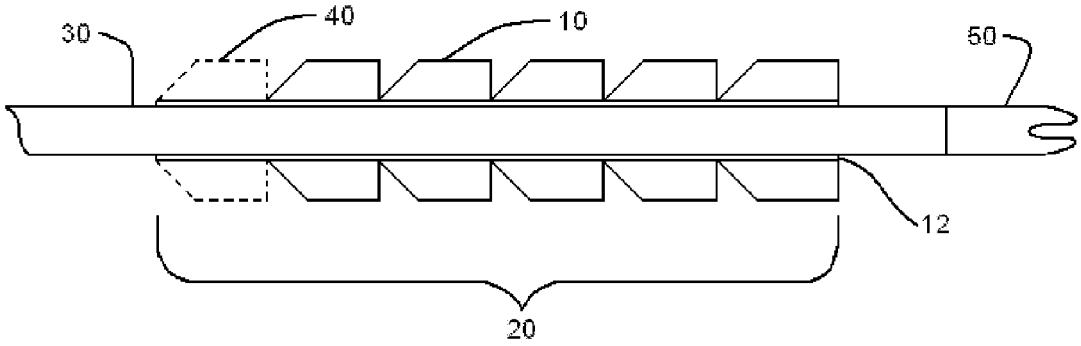
FIG. 1 is a side view of an arrow shaft having placed thereon a five segment section of adjustable fletching material. In dotted lines a sixth segment is shown where it would be positioned if additional fletching material was determined to be required.

As depicted in FIG. 1, vane segments 10 may comprise identical lengths and shapes to facilitate symmetry between fletching areas 20 of the arrow. Indeed, where vane segments 10 are of uniform size and shape, fetching areas 20 may be easily modified and by adding and/or removing vane segments 10 without disrupting fetching balance. Any number of fetching segments 40 may be removed or added to fine tune the balance of the arrow shaft 30 and/or to reduce drag, thus enabling an archer to maximize his chances of accuracy. Ideally, the user may optimize the arrow's speed by minimizing its weight, and it balance at 60-65 per cent forward weight by adding or removing the requisite amount of fletching segments 40. Furthermore, the user may optimize the arrow's aerodynamics by minimizing the amount of fletching segments 40, including having only a single fletching segment 40. Ultimately, the present invention gives the user control to instantly adjust the height of the vein's frontal area and the length of duration in which the arrow stabilizes in flight. By dramatically increasing the veins frontal area, the user dramatically improves the way the vein engages the air, while dramatically reducing the length of the vein, and even the number of veins on the arrow shaft. The weight of the arrow is in turn reduced and the speed of the arrow's flight increases, potentially several feet per second. This increased speed allows the user to shoot the arrow in a flatter trajectory, thus improving the accuracy of the arrow.

Alternatively, vane segments 10 may vary as to length and shape, provided that such segments are arranged in a repeating pattern. In this manner, symmetry between vanes may be maintained while enabling a greater degree of selectivity with respect to the amount of fletching 40 that may be added or removed from each of the vanes 10 to maximize arrow speed and achieve a particular arrow balance. The present invention teaches the fletching's base portion may be easily severed from a contiguous line of fletching and adhered to the arrow shaft 30 near the nock 50, thus allowing a user to bind the fletching segments 40 to the shaft 30 in desired lengths. Such bonding may comprise adhesive bonding, mechanical bonding, or any other bonding means known to those in the art.

Methods of fletching in accordance with the present invention facilitate predictable performance in arrows having the same or nearly identical dimensions as such arrows may be uniformly fletched with the same quality and quantity of vane segments. This reduces consumer waste that occurs during the trial and error process commonly used to obtain symmetry and balance with respect to each individual arrow.

Further, embodiments of the present invention reduce product identification and inventory problems resulting when numerous product codes are used to identify different lengths of the same fletching material. Indeed, a method of fletching in accordance with the present invention simplifies product identification and inventory by enabling use of a single product code in connection with a particular fletching material, since the particular length of fletching material may be customized according to a purchaser's needs. In this manner, costs associated with both marketing and utilizing the fletching material of the present invention may be reduced.

The segmented nature of the vanes in accordance with the present invention also enables the vanes to avoid damage from other arrows. Indeed, such segments increase the flexibility of the vanes and also the ability of the vanes to deflect from the flight path of oncoming arrows.

Finally, the size and shape of the fletching segments enable an arrow to achieve superior aerodynamics, thereby resulting in increased flight distance.

I claim:

1. A method for fletching an arrow comprising: providing a segmented vane fletching material comprising a plurality of vane segments; attaching a length of said segmented vane fletching material to an arrow shaft; modifying said length of said segmented vane fletching material to achieve a desired arrow balance, wherein said modifying comprises adding or removing at least one of said plurality of vane segments.

2. The method of claim 1 where in said method further comprises: maximizing the arrow flight speed by minimizing the weight of fletching attached to the arrow.

3. The method of claim 1 wherein said method further comprises: optimizing the arrow's aerodynamics by instantly adjusting the amount of fletching on the arrow.

4. The method of claim 1 wherein said method further comprises: optimizing the arrow's weight front of center by instantly adjusting the amount of fletching.

5. The method of claim 1 wherein said method further comprises: selectively reducing the amount of fletching to minimize the arrow's weight.

6. The method of claim 1 wherein said method further comprises: maximizing the trajectory of the arrow's flight by reducing the weight of the arrow.

* * * * *